US007704355B2

(12) United States Patent
Meneghini

(10) Patent No.: US 7,704,355 B2
(45) Date of Patent: Apr. 27, 2010

(54) ANODE FOR GAS EVOLUTION REACTIONS

(75) Inventor: Giovanni Meneghini, Milan (IT)

(73) Assignee: Industrie De Nora S.p.A., Milan (IT)

( * ) Notice: Subject to any disclaimer, the term of this patent is extended or adjusted under 35 U.S.C. 154(b) by 307 days.

(21) Appl. No.: 11/829,674

(22) Filed: Jul. 27, 2007

(65) Prior Publication Data

US 2008/0264779 A1 Oct. 30, 2008

Related U.S. Application Data

(63) Continuation of application No. PCT/EP2006/000720, filed on Jan. 27, 2006.

(30) Foreign Application Priority Data

Jan. 27, 2005 (IT) ..... MI2005A0108

(51) Int. Cl.
*C25B 11/03* (2006.01)

(52) U.S. Cl. ..... 204/283; 204/284; 204/288; 204/280; 204/252; 204/253; 204/254; 204/255; 204/256; 204/263; 204/266

(58) Field of Classification Search ..... 204/280, 204/252, 253, 254, 255, 256, 284, 288, 263, 204/264, 265, 266, 283
See application file for complete search history.

(56) References Cited

U.S. PATENT DOCUMENTS 3,591,483 A 7/1971 Loftfield et al.
3,674,676 A * 7/1972 Fogelman ..... 204/288.2
3,790,465 A 2/1974 Giacopelli et al.
4,013,525 A 3/1977 Emsley
4,014,775 A 3/1977 Kircher et al.
4,329,218 A * 5/1982 Sorenson et al. ..... 204/283
5,066,378 A 11/1991 Meneghini
5,534,122 A 7/1996 Traini et al.
5,593,555 A 1/1997 Klatt et al.
2004/0200719 A1* 10/2004 Peragine ..... 204/252
2006/0163081 A1* 7/2006 Meneghini et al. ..... 205/411

FOREIGN PATENT DOCUMENTS

EP 0 203 224 A1 12/1986
EP 0 611 836 A1 8/1994
WO WO 2005/001163 A1 1/2005

* cited by examiner

*Primary Examiner*—Bruce F Bell
(74) *Attorney, Agent, or Firm*—Eschweiler & Associates, LLC

(57) ABSTRACT

The invention describes an improved anode suitable for being installed in chlor-alkali electrolysis cells intercalated to cathode elements provided with a diaphragm.

In operation, the anode of the invention is in direct contact with the diaphragm so as to form mutually equivalent vertical channels defined by the surfaces of the plates, of the supporting sheets and of the diaphragm, allowing a predefined and controlled upward motion of the chlorine-brine biphasic mixture.

28 Claims, 10 Drawing Sheets

ANODE FOR GAS EVOLUTION REACTIONS

REFERENCE TO RELATED APPLICATION

This application is a continuation of PCT/EP2006/000720, filed Jan. 27, 2006, that claims the benefit of the priority date of Italian Patent Application No. IT2005MI00108, filed on Jan. 27, 2005, the contents of which are herein incorporated by reference in their entirety.

BACKGROUND

The production of chlorine and caustic soda is nowadays one of the most relevant electrochemical industrial processes and is carried out in plants based on three distinct technologies, namely the membrane, mercury cathode and diaphragm technologies. The membrane technology is characterised by low electrical energy consumption and by the absence of environmental issues. The two remaining, mercury cathode and diaphragm technologies, which became established during the years following World War 2, were initially characterised by high electrical energy consumption and by serious problems of environmental nature at the time the membrane plant commercialisation was taking place. Nevertheless, both technologies were able to survive, being nowadays still applied in plants whose production represents 60-70% of the world total. Such survival was permitted both for technical reasons, allowing to achieve a substantial decrease in the energy consumption and to reduce or even eliminate the environmental issues (in particular with a substantial decrease in mercury release and with the replacement of the asbestos fibres with fibres of alternative environmentally-friendly composition in diaphragm production) and for financial reasons fundamentally associated with the investment costs, evidently lower in plants already paid-back to a large extent.

As regards the reduction in energy consumption, the diaphragm technology saw the introduction of a series of innovations regarding in particular, although not exclusively, the anode nature and structure. The original anodes consisting of graphite plates were replaced by anodes formed with titanium coarse meshes, configured so as to generate a sort of flattened box (whence the term of current technical use of "box anodes"), provided with a superficial catalytic coating, for instance a ruthenium and titanium mixed oxide coating, suitable for favouring the chlorine evolution reaction. The cell voltage, although significantly decreased, was still negatively influenced by the remarkable gap, indicatively 6-8 mm, existing between the surfaces of the anodes and of the facing diaphragms. For this reason, the box anode was replaced by the expandable anodes, again characterised by a flattened box shape but with the difference that the two major surfaces, again consisting of titanium coarse mesh provided with a catalytic coating, are secured to the central current-collecting stem by elastic sheets, known in the field as "expanders", capable of simultaneously ensuring the electric current transmission alongside a certain mobility. With this type of design, the gap between the anode and diaphragm surfaces could be reduced to about 2-3 mm, with a consequent lessening of the cell voltage and thus of the energy consumption.

Further improvements made to the expandable anode structure consist of devices directed to achieve a better circulation of the brine, with the double aim of maintaining a high chloride concentration on the surface of the catalytic coating and of quickly removing the chlorine bubbles and prevent their adhesion to the diaphragm, thereby ensuring a further cell voltage decrease. Brine circulation devices are, for instance, represented by a suitable shaping of the expanders, by flow deflectors installed on the top of the anodes, and by the substitution of the coarse mesh with vertical plates secured for example to a planar supporting sheet, with the apex of the plates maintained in any case at a distance of 1.5-3 mm from the diaphragm surface. In accordance with a similar device, the plates are fixed on the apexes of folds formed by means of a suitable shaping of the supporting sheet.

The gap between anode and diaphragm surfaces was finally eliminated with a further energy gain through the use of particular expandable anodes associated both with additional compressing elastic elements capable of safely maintaining the movable surfaces of the anodes in contact with substantially the whole diaphragm surface, and with a flattened fine mesh applied upon the previously employed coarse mesh. The fine mesh has the purpose of preventing the surface irregularities of the coarse mesh from eventually damaging the diaphragm with consequent current efficiency drop and short-circuiting hazards. The catalytic coating is applied to both meshes or preferably, in order to limit the production costs, to the fine mesh only.

Anode structures were further modified maintaining the catalytic-coated fine mesh unaltered and replacing the coarse net with horizontally or vertically arranged parallel plates having the purpose of improving the brine circulation. The hydraulic regime guaranteed by the latter expandable-type anode and the simultaneous elimination of the diaphragm-to-anode surface gap allows obtaining better cell voltages and hence a lower electrical energy consumption per unit of product chlorine, for instance 2300 kWh per tonne.

However, these expandable anodes present some inconveniences: in particular, it can be noticed that after about 1000 hours of operation the cell voltage tends to increase with a simultaneous decrease in the current efficiency accompanied by a significant increase of the oxygen content in chlorine. As a consequence, an increase in the electrical energy consumption and an intolerable diminution in the quality of the product chlorine take place. Although no certain proof exists, the cause of such a performance deterioration might be attributed to the progressive penetration of the fine mesh into the diaphragm bulk. If the above assumption is correct, the chlorine evolution takes place at least partially within the diaphragm superficial layers withholding at least a fraction of the bubbles with an electric resistance and hence a cell voltage increase. Furthermore, the alkalinity certainly present inside the diaphragm reacts with the trapped chlorine forming hypochlorite with an electrolysis efficiency drop.

The invention is directed to overcome the above described drawbacks of the prior art by means of a novel expandable anode design.

SUMMARY OF THE INVENTION

In one aspect, the invention is directed to an expandable-type anode suitable for being installed in chlor-alkali electrolysis cells intercalated to cathode elements provided with a diaphragm, comprising a current-collecting stem having a multiplicity of elastic expanders connected thereto and two major movable surfaces secured to the elastic expanders, the movable surfaces comprising assemblies comprising a supporting sheet, parallel vertical profiles secured to the supporting sheet provided with a catalytic coating for chlorine evolution and a fine mesh free of catalytic coating in contact with apexes of the parallel vertical profiles.

In a further aspect, the invention is directed to a method of construction of an anode comprising:

dimensional cutting of a multiplicity of supporting sheets made of titanium or alloys thereof;

optional shaping of the upper part of said supporting sheets to form flow deflectors;

dimensional cutting of a multiplicity of profiles of titanium or alloys thereof;

prefabricating assemblies by welding said profiles to said supporting sheets in a template;

applying a catalytic coating for chlorine evolution to said assemblies removing the catalytic coating at the apexes of said profiles fixing of said prefabricated assemblies; and dimensional cutting and fixing of fine meshes to said apexes of the profiles of said assemblies.

DESCRIPTION OF THE DRAWINGS

The invention will be described hereafter with the support of the following figures.

DETAILED DESCRIPTION

The fundamental scope of the invention is providing an anode design suitable for diaphragm cells capable of ensuring the production of chlorine and caustics, minimising the energy consumption which depends directly on the cell voltage and inversely on the current efficiency.

Figure 1:
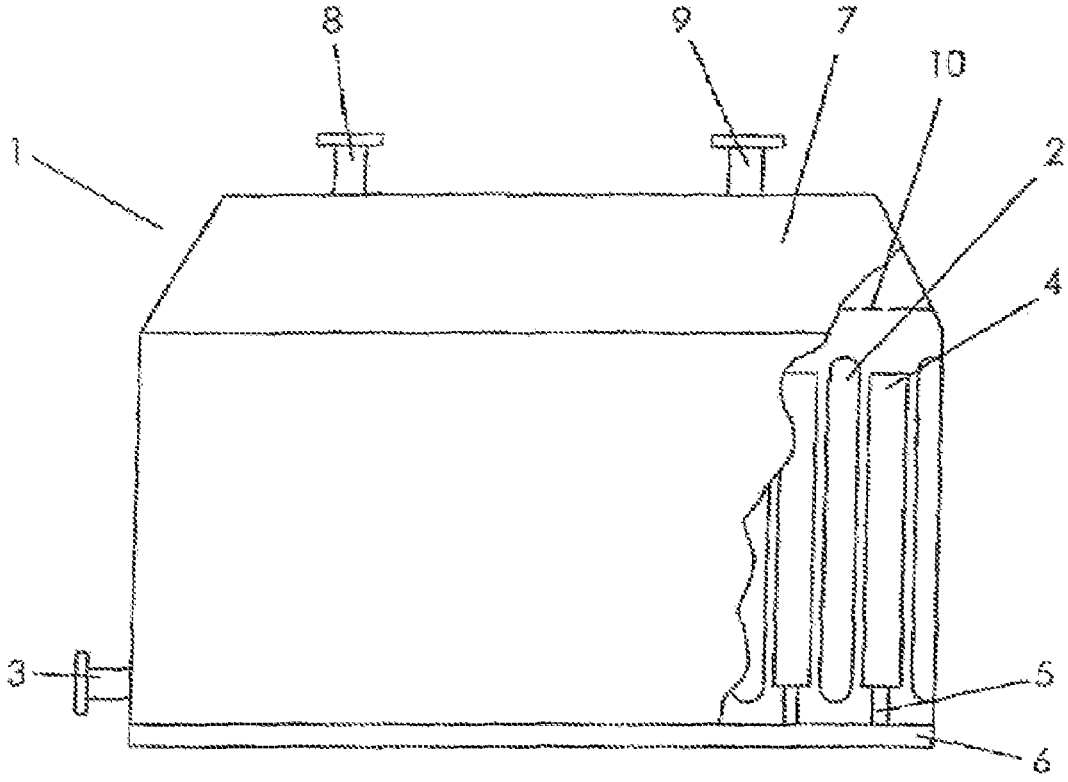
FIG. 1 illustrates a longitudinal section of a diaphragm chlor-alkali electrolysis cell.

FIG. 1 represents the longitudinal section of a diaphragm chlor-alkali cell, wherein (1) identifies the cathode body, (2) the cathode element provided with diaphragm, (3) the discharge nozzle of product caustic soda mixed with the residual brine, (4) the expandable anodes secured through the current-collecting stems (5) to the anodic plate (6) and intercalated to the cathode elements, (7) the cover provided with connections (8) and (9) for the chlorine outlet and the brine inlet, (10) the brine level.

Figure 2:
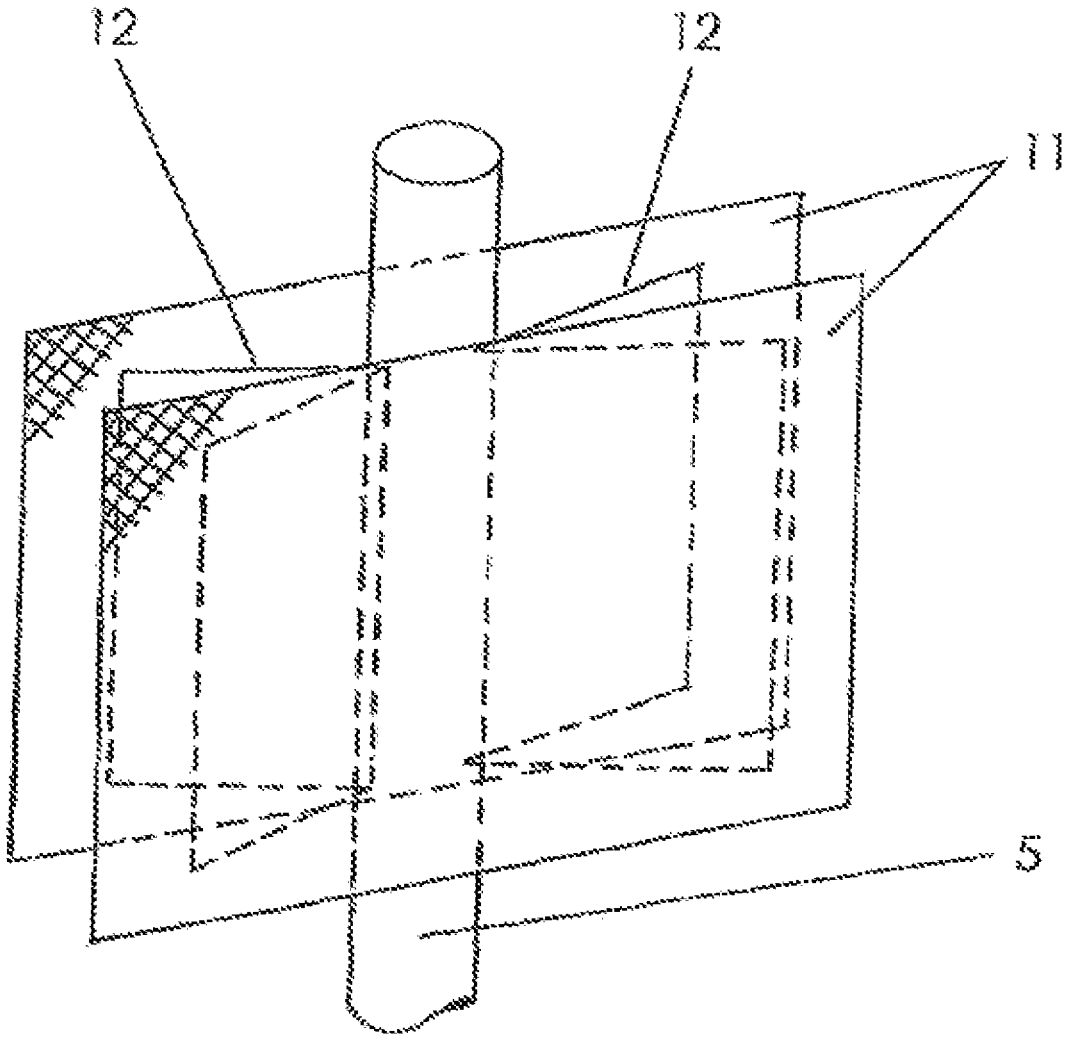
FIG. 2 illustrates a conventional expandable anode.
Figure 3:
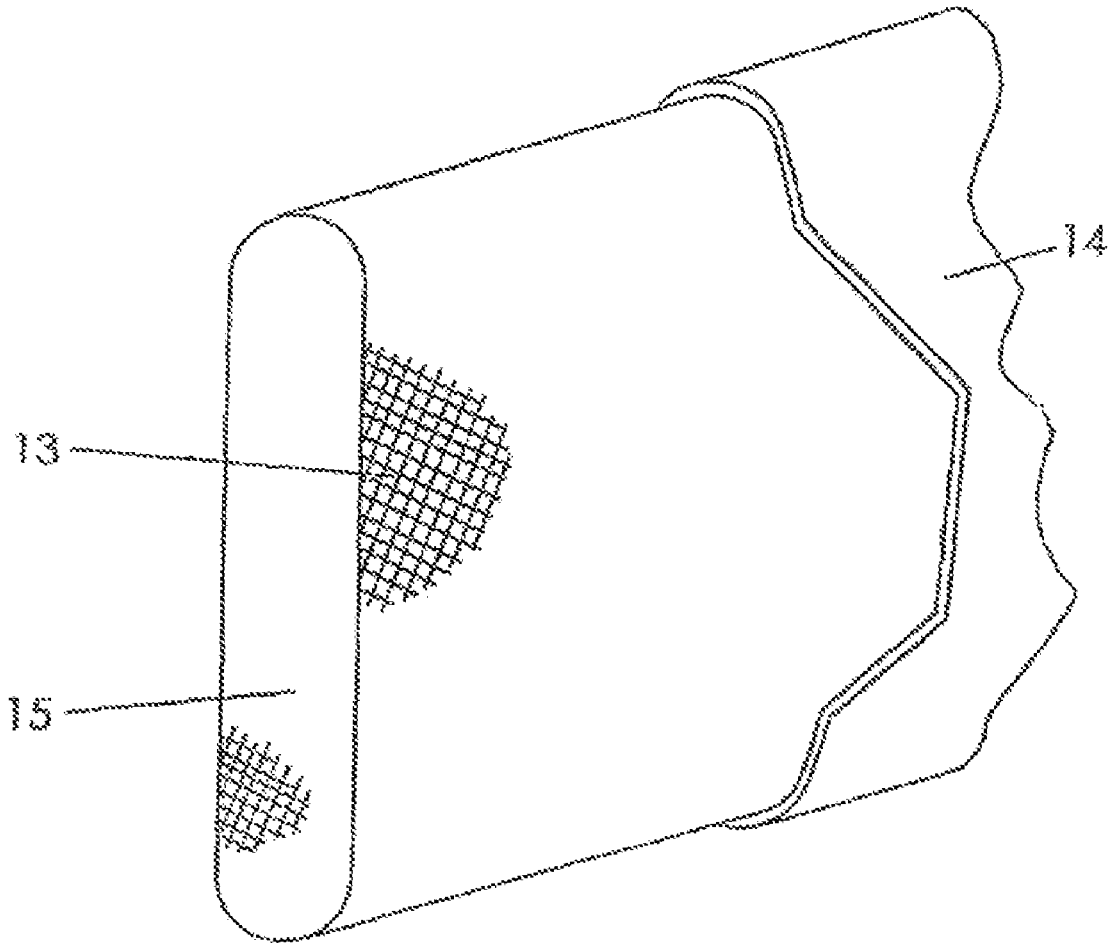
FIG. 3 illustrates a cathode element provided with diaphragm.

The achievement of the scope of cell voltage minimisation requires each anode being of the expandable type and having its two major surfaces in contact with the surface of the diaphragms. FIG. 2 depicts the kind of expandable anode used in the prior art with (11) indicating the two major movable surfaces connected to the current-collecting stem (5) through four strips (12) made of titanium or alloys thereof having a sufficient elasticity and known as expanders. The mobility imparted by the expanders allows the anode major surfaces to come in contact with the surface of the facing diaphragms applied to the cathode elements (an arrangement known in the art as "zero-gap"). FIG. 3 shows a cathode element section, wherein (13) indicates a mesh of interwoven wires or a perforated carbon steel sheet, (14) the diaphragm deposited on the mesh or perforated sheet and comprising fibres of asbestos or other chlorine-resistant material mechanically stabilised with a polymer binder, for example polytetrafluoroethylene or other fluorinated polymer, (15) the internal volume containing the caustic soda mixed with depleted brine connected to the outlet nozzle (3) of FIG. 1.

To ensure the contact along the whole interface with the diaphragms, the expandable anodes may be optionally provided with additional expanding means, as disclosed in U.S. Pat. No. 5,534,122.

The invention provides a first modification of the conventional expandable anode structure directed to prevent the current efficiency decay afflicting the long-term operation with zero-gap arrangement of the prior art. Such modification comprises the insertion of a fine mesh in the anode-diaphragm interface, either made of titanium or alloys thereof and free of catalytic coating or of a chlorine and alkali-resistant polymeric material, for instance of a fluorinated polymer with the optional addition of hydrophilic particles or fibres. If the material employed is titanium or an alloy thereof, the fine mesh may be secured to the expandable anode movable surfaces by electric welding, for example, of the resistance type.

The fine mesh proves necessary to minimise the penetration inside the diaphragms, and for this reason its dimensions, expressed as number of meshes per square centimetre, are comprised in one embodiment from between 4 and 100, and in one embodiment between 6 and 9. Moreover, the mesh of the invention comprises a thickness between 0.3 and 1 millimetres in one embodiment, and in another embodiment from 0.3 to 0.5 millimetres. The mesh must be free of asperities to prevent the direct contact with the diaphragm from producing damages which could lower the current efficiency and in extreme cases provoke harmful short-circuits. In the case of titanium fine meshes, it is advantageous to resort to flattened expanded sheets.

The titanium fine mesh does not produce chlorine inside the diaphragms, even though in principle its partial penetration into the diaphragms themselves cannot be excluded, since being free of catalytic coating it gets covered in operation by a thin layer of electrically non-conductive oxide. Even more so, the same result is obtained when a fine mesh consisting of a polymeric material is used.

The achievement of a current efficiency stable in time also requires the brine to be subjected to a quick recirculation, in order to maintain the chloride concentration on the catalysed surfaces more or less constant. The brine recirculation, moreover, must ensure that the chlorine bubbles, which have some tendency to stick to the diaphragm surfaces, in particular with the asbestos-free diaphragms of the latest generation, are removed in order to eliminate any possible obstacle to the unimpeded passage of the electric current. In order to obtain such a result, it is necessary to establish an upward brine flow along the diaphragm surface characterised in each point by linear velocities comprised between 0.1 and 0.3 metres per second. Velocities outside this range are disadvantageous, since below 0.1 metres per second results in an excessive chlorine bubble adhesion, while with velocities above 0.3 metres per second some removal of the diaphragm fibres occurs, with a consequent progressive thinning associated with a strong current efficiency drop.

The optimum range of brine circulation velocity is achievable with an anode whose movable surfaces comprise assemblies each comprising a supporting sheet whereon parallel vertical profiles are secured, preferably of equal length and equally spaced. The assemblies, whose surface is in contact with the fine mesh, are maintained in a contact as complete as possible with the diaphragm surface. In this way, a multiplicity of individual channels is generated, each delimited by the surfaces of the plates, the supporting sheets and the diaphragm. If the profiles are equally spaced, the passage sections of the channels are equivalent and being the profile length equal, also the upward velocity of the brine in the various channels is substantially the same.

In order to achieve the most extended possible contact between assembly and diaphragm, the movable surfaces of the anode of the invention are, in one embodiment, subdivided into four independent sections, each secured to a single expander.

The profiles comprise plates, draw pieces with U-shaped section, frets, rods of circular or triangular section. For the sake of simplicity of the description, reference will be made hereafter to anode structures comprising four independent sections and to plate-shaped profiles, by no means limiting the type of anode in accordance with the invention that can be adopted in the industrial practice.

Figure 4:
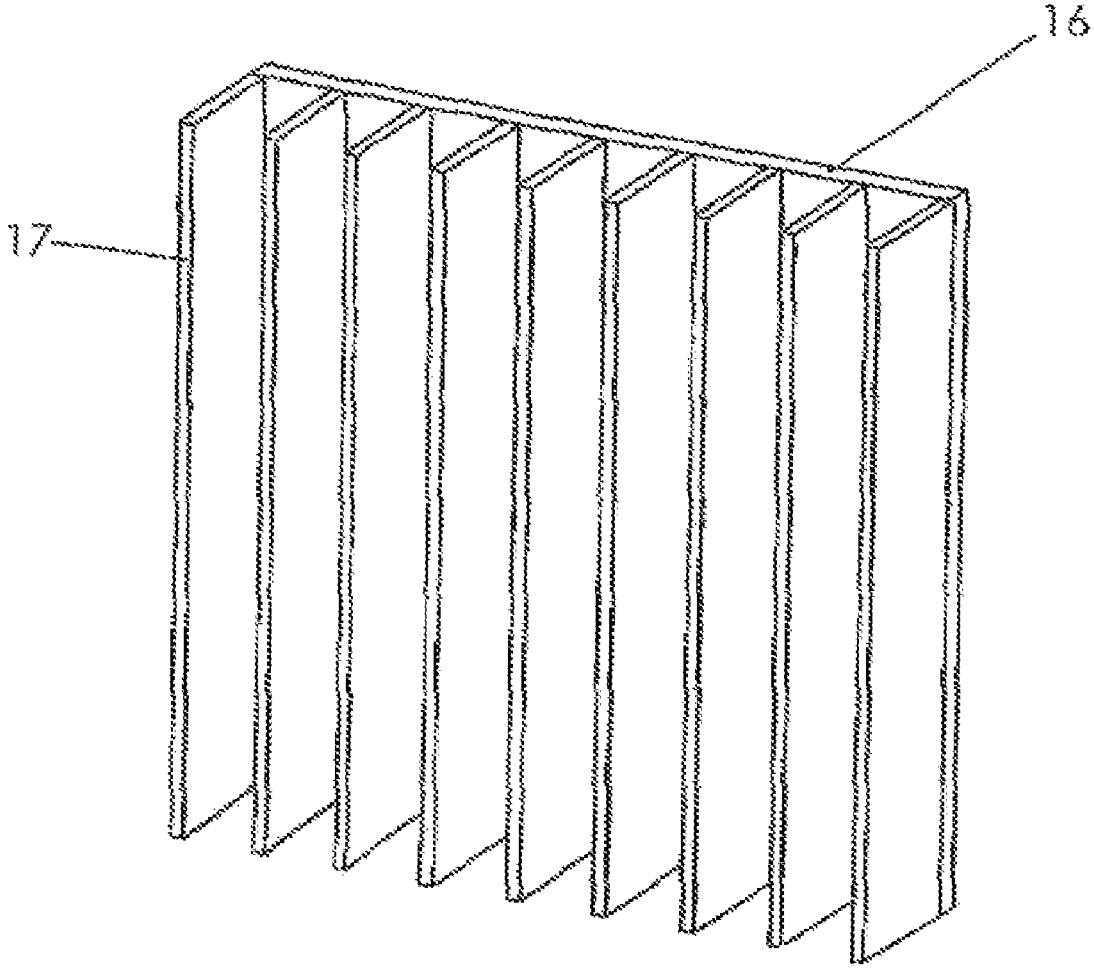
FIG. 4 illustrates an assembly in accordance with an embodiment of the invention comprising a supporting sheet with equally spaced parallel vertical plates fixed thereto.

FIG. 4 shows an assembly according to the invention, wherein (16) indicates the supporting sheet, (17) the parallel vertical plates, preferably equally spaced.

Figure 5:
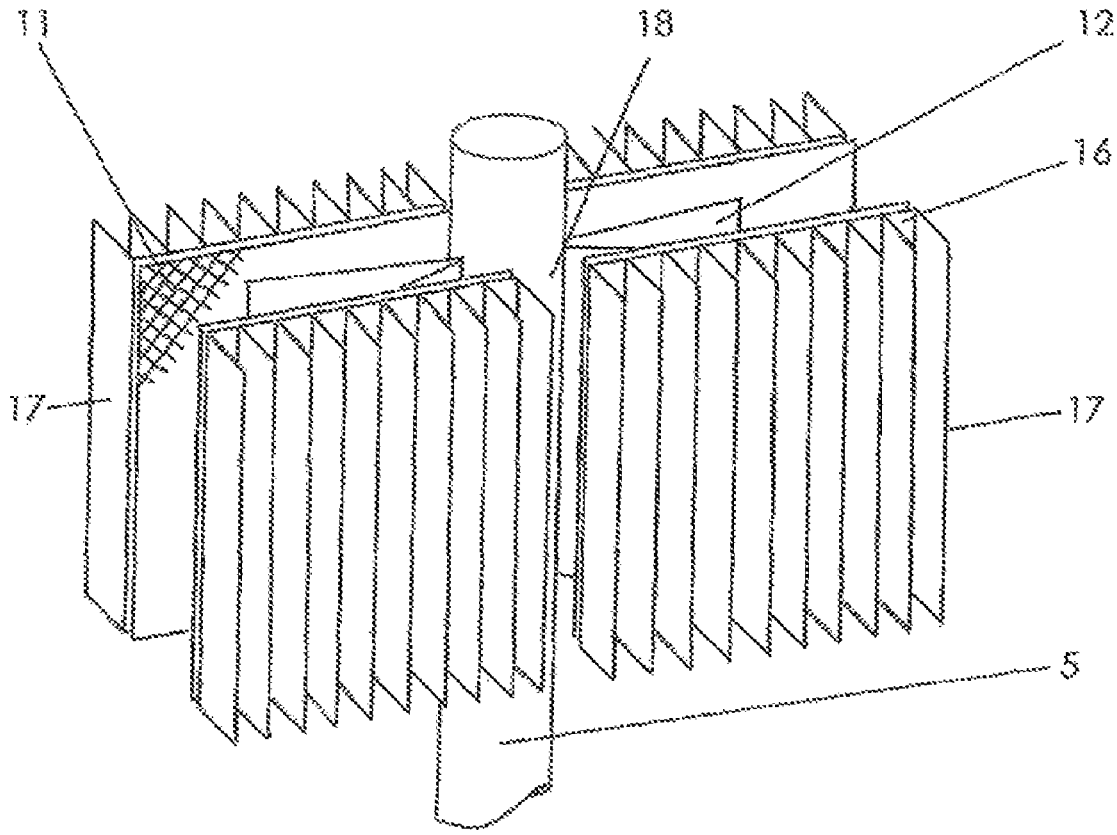
FIG. 5 illustrates an anode with assemblies of FIG. 4 secured to movable surfaces of a previously operated anode.

FIG. 5 represents an embodiment of the anode according to the invention wherein four independent sections, each connected to an expander, comprise four assemblies secured to the original movable surfaces of a previously operated expandable anode of the prior art after sectioning said movable surfaces along the vertical median axis (18).

Figure 6:
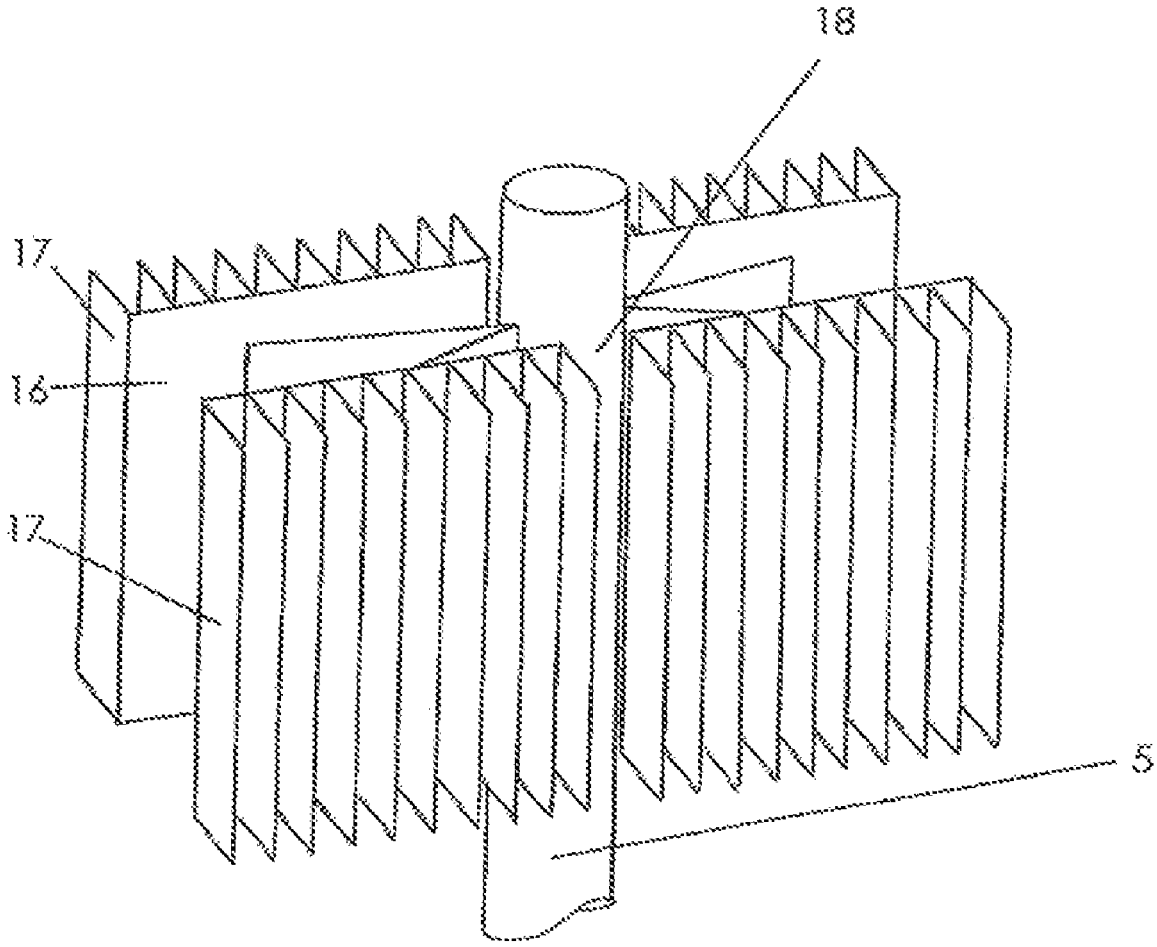
FIG. 6 illustrates an anode with assemblies of FIG. 4 secured to expanders of a newly constructed current-collecting stem.

FIG. 6 represents another embodiment of the anode of the invention wherein four independent portions comprise four assemblies directly secured to the expanders connected to a newly constructed current-collecting stem.

Figure 7:
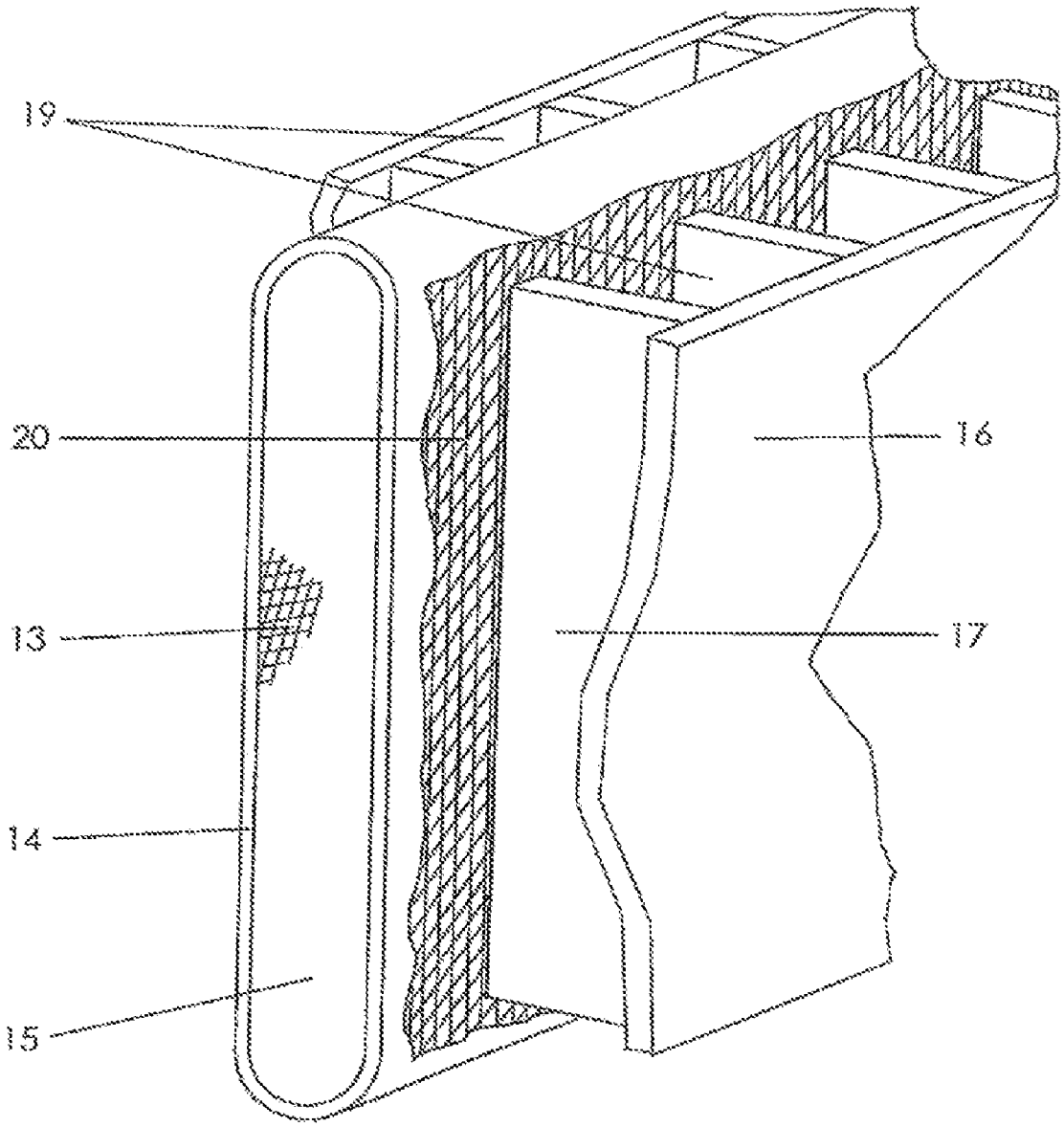
FIG. 7 illustrates an anode according to the invention in a zero-gap configuration with a cathode element provided with diaphragm, with a fine mesh interposed thereto.

FIG. 7 shows a cut-away view of an anode of the invention in a zero-gap relation to a cathode element provided with diaphragm, wherein (19) indicates the individual channels available for the upward motion of the biphasic chlorine-brine mixture, (20) a fine mesh interposed between assemblies and cathode element, the other components in common with the previous figures being identified by the same reference numerals.

It has been found that if the plates have a thickness comprised between 0.3 and 1.0 millimetres, a width of 2-10 millimetres in one embodiment, and 3-5 millimetres in one embodiment, and a length of 600-800 millimetres, the brine upward velocity for every individual channel falls in the optimal range of 0.1-0.3 metres per second with a gas volume content in the order of 15-30% at an applied current density of 2000-3000 $A/m^2$.

The catalytic coating for chlorine evolution is applied to the plates of every assembly and optionally also to the supporting sheets, on the face whereon the plates are secured. Although not fundamental for the sake of preserving the current efficiency, the plate apex surfaces contacting the fine mesh should be free of catalytic coating. Since during the coating application, which carried out as known in the art by spraying, brushing or rolling, it is practically not possible to avoid the deposition also on such surface, it is useful that every plate-supporting sheet assembly be subjected to an abrasion post-treatment allowing both to remove the catalytic coating from the plate apexes and to obtain a high planarity, which is advantageous for achieving the widest and most uniform possible anode-diaphragm interface.

Figure 8:
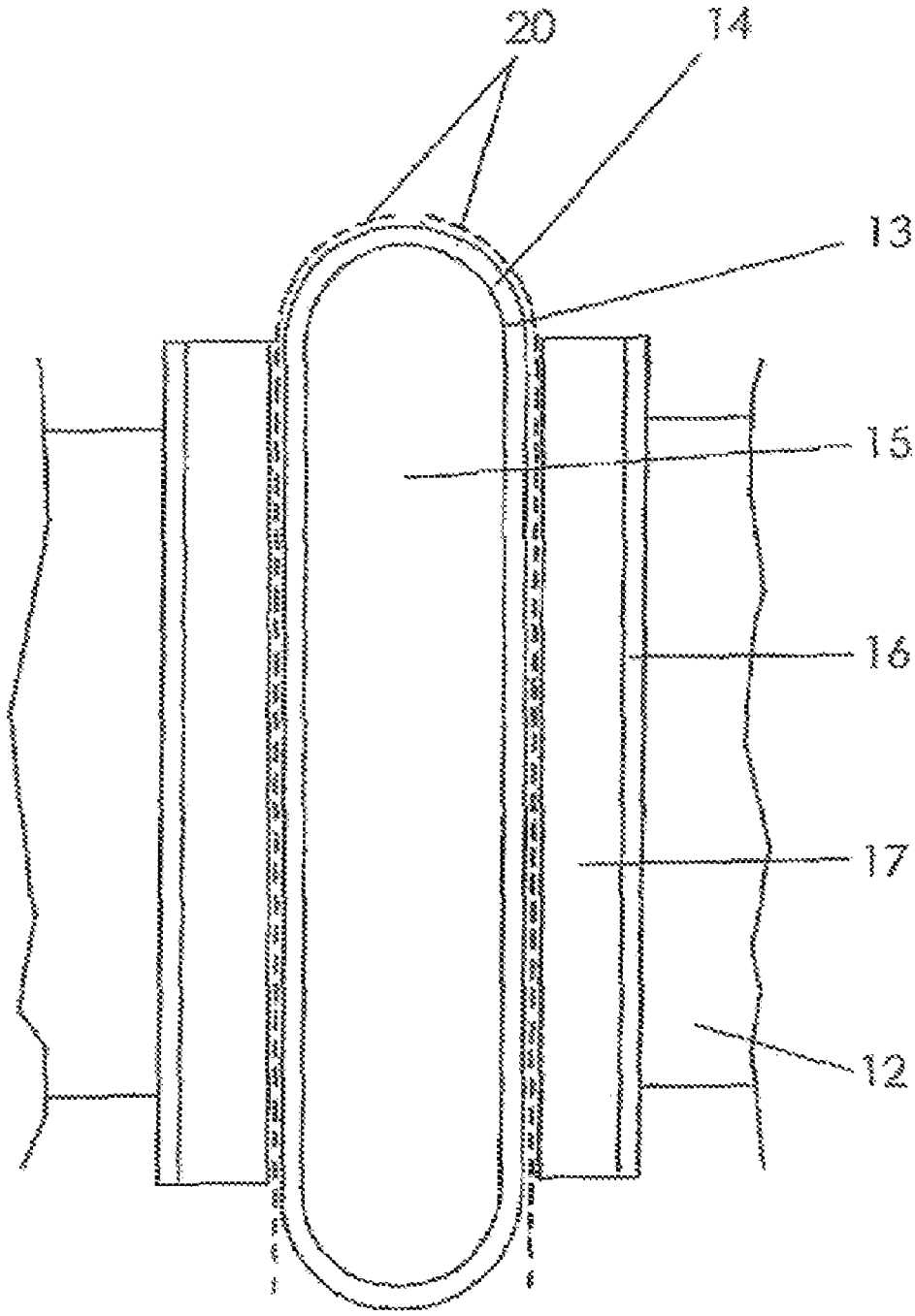
FIG. 8 illustrates: expansion of a fine mesh shaped according to the profile of the upper part of the cathode element.

The invention can be further integrated as indicated hereafter:

The fine mesh may be advantageously extended beyond the plate edge as shown in FIG. 8, the extension (21) being shaped in order to match the upper profile of the diaphragm-bearing cathode elements, where the erosive phenomena are particularly significant as it is known to those skilled in the art. This positioning of the fine mesh contributes to protect the diaphragm fibres from the turbulent flow of the chlorine-brine biphasic mixture, hence slowing down their wear to a substantial extent. In one embodiment, the protection from the erosion can be also achieved by using a separate piece of fine mesh, shaped as mentioned and suitable for being elastically inserted in the upper part of the cathode elements. The material of the mesh piece, besides titanium or alloys thereof, can be a chlorine and alkali-resistant polymer, optionally added with hydrophilic particles or fibres.

Figure 9:
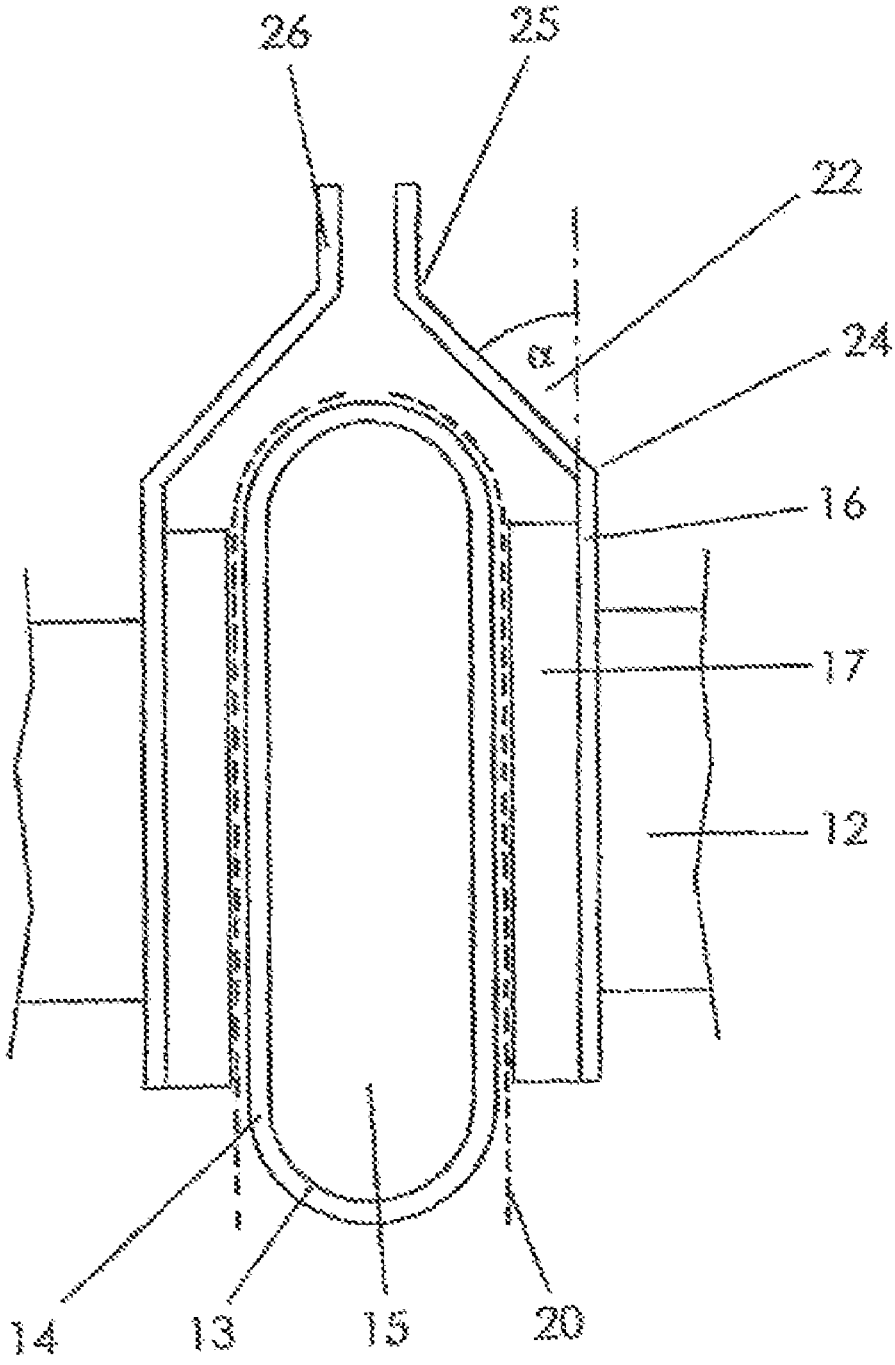
FIG. 9 illustrates a flow deflector formed by folding of the prolongation of the upper part of a supporting element of an assembly according to the invention.

The flow deflectors can be obtained by machining of a suitable prolongation of the supporting sheets or by separate pieces of solid sheet. Each prolongation of supporting sheet or separate sheet piece is shaped so as to obtain a first fold with an angle $\alpha$ smaller than 90° with the vertical in one embodiment, and in another embodiment comprised between 30° and 60°, and optionally a second fold suitable to form a final portion having vertical orientation. FIG. 9 shows a deflector (22) obtained by shaping of the prolongation (23) of the supporting sheet of an assembly, wherein (24) and (25) respectively indicate the first and the second fold and (26) the final portion with vertical orientation. In the case of deflectors produced by shaping of separate pieces of sheet, the latter can either be made of titanium or alloys thereof or of a chlorine and alkali-resistant polymer material, and the individual deflectors are mechanically inserted in the plate-supporting sheet assemblies.

Figure 10:
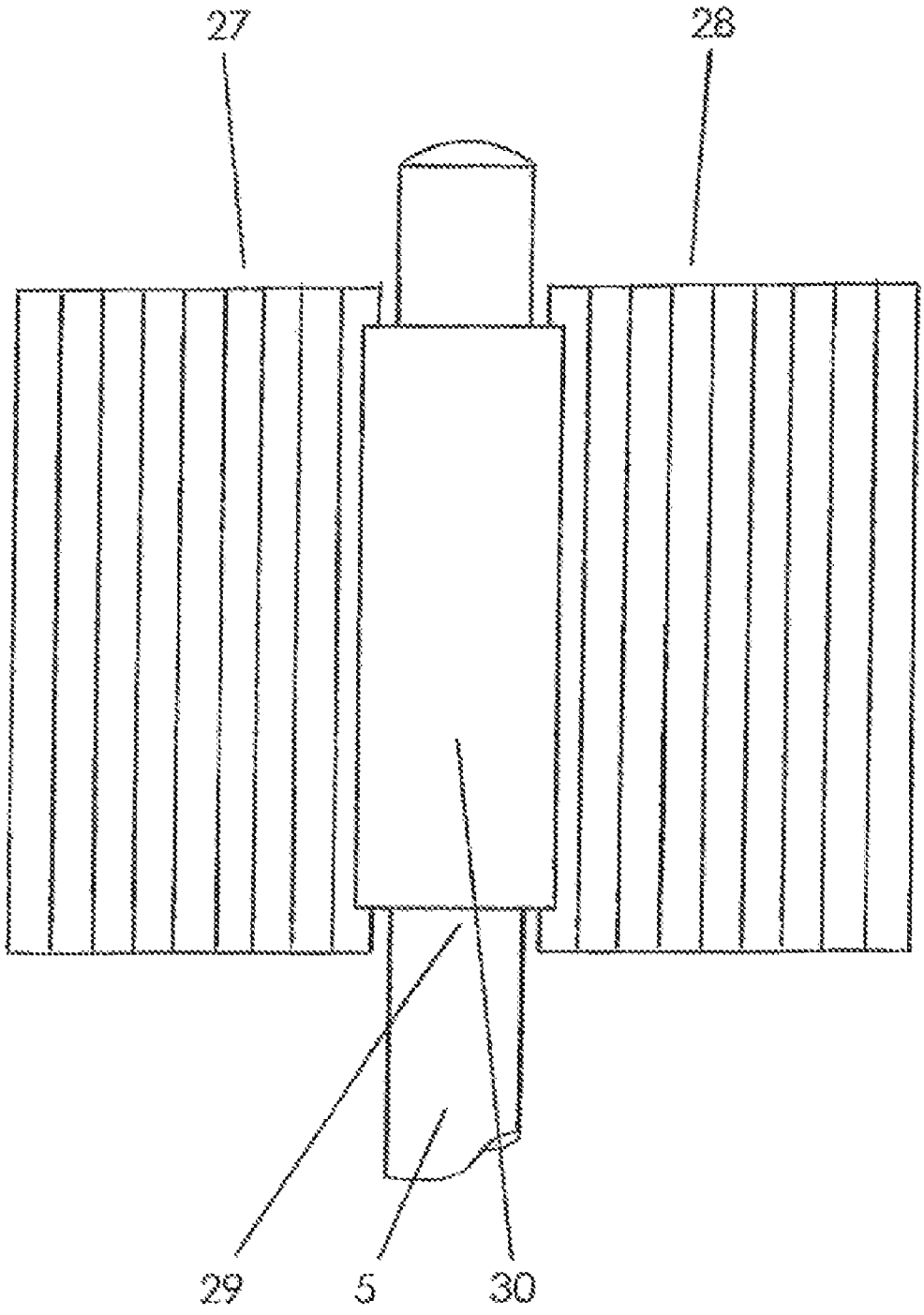
FIG. 10 illustrates fixing of elastic strips to the adjacent sections of the movable surfaces of an anode according to the invention.

The two adjacent sections of each movable surface of the anode of the invention are connected to each other, for example, through a titanium sheet strip having a highly elastic behaviour, as obtainable for instance with a 0.5 mm thick strip, secured for instance by spot-welding to the two facing edges of each pair of sections as shown in the front-view of FIG. 10, wherein (27) and (28) identify the two adjacent sections of a single movable surface, (29) the hollow space existing between the two edges of the two adjacent sections and (30) the flexible strip secured to said edges. With this configuration a higher structural stability is imparted to the anode without, however, diminishing to a substantial extent the adaptability of the two sections of each movable surface to the diaphragm surface. The strip is provided with catalytic coating in order to maintain a uniform flow of electric current also in correspondence of the hollow gap necessarily present between the two facing edges of each pair of adjacent sections. The uniformity of distribution of the electric current along the whole surface of the diaphragms is in fact of substantial importance for maintaining a high current efficiency. In another embodiment, the facing edges of each pair of adjacent sections of the anode movable surfaces may protrude laterally from the outermost plate without however being mechanically connected. If the protruding portions are provided with catalytic coating, the necessary uniformity of current distribution is achieved also in this case, even though the lack of the elastic connecting strip demands a higher care in the installation steps of the whole anodic structure to avoid damaging the diaphragms.

The anode according to the invention is assembled proceeding as a first step to the prefabrication of the plate-supporting sheet assemblies and carrying out in a second step the application of the prefabricated piece either on a previously operated expandable anode of the prior art, for instance in correspondence of a recoating treatment when the catalytic activity of a spent catalytic coating must be restored, or to the expanders of a current-collecting stem in case of newly fabricated anodes.

The most significant steps are the following:

Dimensional cutting of the four supporting sheets of titanium or alloys thereof.

Formation of the flow deflector by shaping of each supporting sheet. Alternatively, the flow deflector may be a separate piece from the supporting sheet obtained by dimensional cutting of a suitable sheet of titanium or alloys thereof or of polymeric material, with subsequent shaping.

Cutting of the plates of titanium or alloys thereof.

Positioning of the plates and of the relevant supporting sheets in a template.

Fixing of the plates to the relevant supporting sheets by continuous welding, preferably resistance electric welding with formation of four plate-supporting sheet assemblies.

Application of the catalytic coating for chlorine evolution to each of the four assemblies.

Removal of the catalytic coating only from the plate apexes of each assembly by milling.

Preparation of a previously operated expandable anode of the prior art by cutting along the vertical median axis of each of the original movable surfaces with formation of four independent sections. In case of fabrication of new anodes, preparation of a current-collecting stem with four expanders secured thereto.

Formation of the four independent sections of the movable surfaces of the anode by fixing of each of the four plate-supporting sheet assemblies to the movable surfaces of the previously operated anode cut along the vertical median axis by one or more of electric resistance, electric arc or laser welding. In one embodiment, in the case of new anode construction, formation of the four independent sections of the movable surfaces of the anode by fixing of each of the four plate-supporting sheet assemblies to the four expanders of the current-collecting stem by welding, for example, laser welding. Optional application of an elastic strip provided with catalytic coating by further spot or continuous welding to the facing edges of each pair of adjacent sections.

Dimensional cutting of four fine meshes of uncoated titanium or alloys thereof or of a chlorine and alkali-resistant polymer material, optionally added with hydrophilic particles of fibres.

Shaping of the optional d of each of the four fine meshes in order to replicate the cathode element upper part profile. Alternatively the shaping step can be carried out on separate fine mesh pieces suitable for being elastically fitted onto the cathode elements.

Optional fixing of the four fine meshes on the plate apexes of each of the four assemblies by welding, preferably electric resistance welding, in case of sections made of titanium or alloys thereof.

EXAMPLES

The following examples are included to demonstrate particular embodiments of the invention. It should be appreciated by those of skill in the art that the techniques disclosed in the examples which follow represent techniques discovered by the inventors to function well in the practice of the invention. However, those of skill in the art should, in light of the present disclosure, appreciate that many changes can be made in the specific embodiments which are disclosed and still obtain a like or similar result without departing from the spirit and scope of the invention.

An anode of the above-described type was installed in a lab diaphragm cell having a 250 mm wide and 800 mm high active surface equipped with an expandable anode of the invention installed between a pair of cathode elements consisting of interwoven carbon steel wires and provided with asbestos fibre-based diaphragms stabilised with polytetrafluoroethylene. The cell was operated at a current density of 2500 A/m$^2$, at 90-95° C., with a purified brine feed containing 315 g/l sodium chlorine and 0.5 mg/l calcium+magnesium, the outlet solution containing on average 130 g/l caustic soda and 185 g/l residual sodium chloride.

In Particular the Anode Presented the Following Constructive Features:

- 10 mm diameter titanium cylindrical current-collecting stem, provided with four expanders obtained from flexible 0.5 mm thick titanium sheet
- Four titanium supporting sheets, each 1 mm thick and 120 mm wide, secured to the four expanders by continuous laser welding, the upper edge of each sheet being provided with a shaped prolongation with the major portion angled at 300 from the vertical and with the terminal edge vertically oriented to form a 5 mm passage for the chlorine-brine ascending mixture.
- Titanium vertical parallel plates, of 4 mm pitch, each plate being 0.5 mm thick, 5 mm wide and 800 mm high, secured to each supporting sheet by continuous resistance electric welding with formation of four assemblies Catalytic coating for chlorine evolution consisting of ruthenium and titanium mixed oxide as known in the art on the surface of each plate-supporting sheet assembly with the exception of the plate apexes
- Fine mesh in form of titanium flattened expanded sheet, free of catalytic coating, 0.5 mm thick and with rhomboidal openings characterised by major and minor diagonal of respectively 3 and 2 millimetres, spot-welded to the plate apexes of each assembly, for instance by resistance electric welding.

The cell performance was compared to that of an equivalent reference cell, which was distinguished from the cell according to the invention by being equipped with the anode disclosed in U.S. Pat. No. 5,534,122, with the two movable surfaces consisting of titanium expanded sheets free of catalytic coating obtained from 1 mm thick sheet with rhomboidal openings having major and minor diagonal respectively of 15 and 10 mm, each supporting sheet being secured to a pair of expanders by laser welding, coupled with two fine titanium flattened expanded sheets provided with catalytic coating, obtained from a 0.5 mm thick sheet with rhomboidal openings characterised by major and minor diagonal respectively of 3 and 2 mm, secured to the supporting sheets by resistance electric welding.

The movable surfaces of both the anode according to the invention and the reference anode were maintained in contact with the diaphragms through the elastic force of the expanders.

The functioning of the two cells was characterised by the following parameters:

Cell Equipped with the Anode According to the Invention:

- voltage of 3.1 volts stable until the end of the test after 3500 hours of electrolysis starting current efficiency of 97%, stabilised at 95% after about 1500 hours, respectively corresponding to an electrical energy consumption of 2416 and 2467 kWh per tonne of chlorine oxygen content in chlorine initially equal to 1%, with stabilisation at 2% after about 1500 hours anolyte pH comprised between 3.3 and 3.5

Cell Equipped with the Reference Anode:

initial voltage of 3.3 volt stabilised at 3.4 volt after 150 ore of operation, until the end of the test after 3400 hours starting current efficiency of 95%, with progressive decrease to 93% in the course of the test, with an electrical energy consumption of respectively 2626 and 2764 kWh per tonne of chlorine oxygen content in chlorine initially equal to 2% with an increase up to 3% in the course of the test anolyte pH comprised between 3.5 and 4.0.

Although the disclosure has been shown and described with respect to one or more embodiments and/or implementations, equivalent alterations and/or modifications will occur to others skilled in the art based upon a reading and understanding of this specification. The disclosure is intended to include all such modifications and alterations and is limited only by the scope of the following claims. In addition, while a particular feature may have been disclosed with respect to only one of several embodiments and/or implementations, such feature may be combined with one or more other features of the other embodiments and/or implementations as may be desired and/or advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. An expandable-type anode suitable for being installed in chlor-alkali cells intercalated to cathode elements provided with a diaphragm, comprising a current-collecting stem having a multiplicity of elastic expanders connected thereto and two major movable surfaces secured to said elastic expanders, said movable surfaces comprising assemblies comprising a supporting sheet, parallel vertical profiles secured to said supporting sheet provided with a catalytic coating for chlorine evolution and a fine mesh free of catalytic coating in contact with apexes of said parallel vertical profiles.

2. The anode of claim 1, wherein said movable surfaces are sectioned along a vertical median axis to form a multiplicity of independent sections, each section comprising one of said assemblies.

3. The anode of claim 2, wherein said multiplicity of independent sections comprises four sections.

4. The anode of claim 2, comprising an elastic strip of titanium provided with catalytic coating for chlorine evolution secured to edges of each pair of adjacent sections of each of said movable surfaces.

5. The anode of claim 4, wherein facing edges of each pair of said adjacent sections of each of said movable surfaces are mutually protruding and provided with catalytic coating for chlorine evolution.

6. The anode of claim 2, wherein said independent sections are secured to the movable surfaces of a previously operated anode sectioned along the vertical median axis.

7. The anode of claim 2, wherein said independent sections are secured to expanders connected to newly constructed current-collecting stems.

8. The anode of claim 1, wherein said assemblies comprise one or more of titanium or alloys thereof.

9. The anode of claim 1, wherein said parallel vertical profiles are equally spaced.

10. The anode of claim 9, wherein said profiles are plates, draw pieces with U-shaped section, frets or rods, optionally having a circular or a triangular section.

11. The anode of claim 10, wherein said profiles are plates and said plates have a thickness comprising between 0.3 and 1 mm, a pitch comprising between 2 and 5 mm, a width comprising from 2 to 10 mm, and a length comprising from 600 to 800 mm.

12. The anode of claim 1, wherein said fine mesh comprises a chlorine and alkali-resistant polymer material added with hydrophilic particles or fibres.

13. The anode of claim 1, wherein said fine mesh comprises a flattened expanded sheet of titanium or alloys thereof free of catalytic coating.

14. The anode claim 13, wherein said fine mesh has a thickness comprised between 0.3 and 1 mm.

15. The anode of claim 1, wherein said fine mesh has a number of meshes per square centimeter comprising between 4 and 100.

16. The anode of claim 15, wherein said fine mesh has a number of meshes per square centimeter comprised between 6 and 9.

17. The anode of claim 1, further comprising an element shaped in accordance with the profile of the upper part of the cathode elements and suitable for being elastically inserted thereon.

18. The anode of claim 17, wherein said shaped surface comprises a prolongation of the upper edge of said fine mesh.

19. The anode of claim 17, wherein said shaped surface comprises a separate piece comprising a fine mesh.

20. The anode of claim 19, wherein the material of said separate piece comprises one or more of titanium, titanium alloys and/or chlorine and alkali-resistant polymers added with hydrophilic particles or fibres.

21. The anode of claim 1, wherein said assemblies comprise flow deflectors for favouring the coalescence of the chlorine bubbles.

22. The anode of claim 21, wherein said flow deflectors comprise a sheet with a surface angled less than 90° from the vertical and, optionally, a vertical terminal surface.

23. The anode of claim 22, wherein said sheet comprises an integral part of the supporting sheet of said assemblies.

24. The anode of claim 22, wherein said sheet comprises a separate piece suitable for being mechanically inserted into said assemblies.

25. The anode of claim 24, wherein the material of said separate piece comprises one or more of titanium, titanium alloys and/or chlorine and alkali-resistant polymers added with hydrophilic particles or fibres.

26. A chlor-alkali electrolysis cell comprising cathode elements provided with the diaphragms and anodes of claim 1 intercalated thereto.

27. The cell of claim 26, wherein movable surfaces comprising assemblies are in contact with said diaphragms so as to form vertical channels delimited by profiles, a supporting sheet of said assemblies and by said diaphragms.

28. A chlor-alkali electrolysis process carried out in at least one cell of claim 27 fed with brine and supplied with electric current comprising the generation of an upward motion of the brine in channels with velocity comprising between 0.1 and 0.3 meters per second.

* * * * *